US011772934B2

(12) United States Patent
Cambruzzi et al.

(10) Patent No.: US 11,772,934 B2
(45) Date of Patent: Oct. 3, 2023

(54) MOUNTING FRAME FOR DISPLACING AND FIXING IN A SHAFT

(71) Applicant: Inventio AG, Hergiswil (CH)

(72) Inventors: Andrea Cambruzzi, Zurich (CH); Oliver Simmonds, Lucerne (CH); Philipp Zimmerli, Harkingen (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/755,675

(22) PCT Filed: Nov. 3, 2020

(86) PCT No.: PCT/EP2020/080812
§ 371 (c)(1),
(2) Date: May 5, 2022

(87) PCT Pub. No.: WO2021/094137
PCT Pub. Date: May 20, 2021

(65) Prior Publication Data

US 2022/0380178 A1 Dec. 1, 2022

(51) Int. Cl.
*B66B 7/02* (2006.01)
*B66B 11/00* (2006.01)
*B66B 19/00* (2006.01)

(52) U.S. Cl.
CPC ..... *B66B 7/024* (2013.01); *B66B 11/0005* (2013.01); *B66B 19/00* (2013.01)

(58) Field of Classification Search
CPC ..... B66B 7/024; B66B 11/0005; B66B 19/00
See application file for complete search history.

(56) References Cited

U.S. PATENT DOCUMENTS

2012/0217101 A1* 8/2012 Peacock ..... B66B 11/0045 29/428
2012/0291395 A1* 11/2012 Plathin ..... B66B 19/02 52/741.1

(Continued)

FOREIGN PATENT DOCUMENTS

CN 110306776 A * 10/2019 ..... E04G 3/246
CN 113233287 A * 8/2021 ..... B66B 11/0226

(Continued)

OTHER PUBLICATIONS

CN-111302187—Machine Translation (Year: 2018).*

*Primary Examiner* — Michael A Riegelman
(74) *Attorney, Agent, or Firm* — William J. Clemens; Shumaker, Loop & Kendrick, LLP

(57) ABSTRACT

A mounting frame for being displaced and fixed in a shaft has a main frame, a first primary fixing component for supporting the mounting frame on a first shaft wall of the shaft and a secondary fixing component for supporting the mounting frame on a second shaft wall of the shaft opposite the first shaft wall in a fixing direction during fixing of the mounting frame in the shaft. The first primary fixing component and the secondary fixing component are arranged on the main frame. The first primary fixing component and/or the main frame can assume a transport position and a working position. A change of the first primary fixing component and/or the main frame from its working position to its transport position leads to a reduction in an extension of the mounting frame in an extension direction that differs from the fixing direction.

16 Claims, 2 Drawing Sheets

(56) References Cited

U.S. PATENT DOCUMENTS

| | | | | |
|---|---|---|---|---|
| 2014/0000987 | A1* | 1/2014 | Peacock | B66B 9/187<br>187/414 |
| 2018/0208439 | A1* | 7/2018 | Studer | B66B 11/0005 |
| 2019/0276277 | A1* | 9/2019 | Christen | B66B 19/00 |
| 2020/0055709 | A1* | 2/2020 | Cambruzzi | B66B 19/002 |
| 2020/0180912 | A1* | 6/2020 | Li | B66B 11/0446 |
| 2020/0277158 | A1* | 9/2020 | Christen | B66B 5/284 |
| 2020/0299105 | A1* | 9/2020 | Cambruzzi | B66B 19/002 |
| 2020/0377339 | A1* | 12/2020 | Cambruzzi | G01C 15/004 |
| 2021/0130136 | A1* | 5/2021 | Cambruzzi | B66B 19/00 |
| 2021/0139286 | A1* | 5/2021 | Cambruzzi | B66B 19/002 |
| 2021/0156666 | A1* | 5/2021 | Cambruzzi | B66B 19/00 |
| 2021/0323793 | A1* | 10/2021 | Cambruzzi | B66B 19/00 |
| 2022/0009006 | A1* | 1/2022 | Cambruzzi | G05B 19/402 |
| 2022/0380177 | A1* | 12/2022 | Cambruzzi | B66B 19/00 |
| 2022/0380178 | A1* | 12/2022 | Cambruzzi | B66B 7/024 |
| 2023/0041465 | A1* | 2/2023 | Cambruzzi | B66B 19/00 |
| 2023/0049422 | A1* | 2/2023 | Achermann | B62B 3/02 |

FOREIGN PATENT DOCUMENTS

| | | | | | |
|---|---|---|---|---|---|
| CN | 111302187 | B | * | 9/2022 | B66B 11/043 |
| DE | 102018208588 | A1 | | 7/2019 | |
| JP | H10147481 | A | | 6/1998 | |
| WO | 2017016780 | A1 | | 2/2017 | |
| WO | 2018162350 | A1 | | 9/2018 | |
| WO | WO-2021144154 | A1 | * | 7/2021 | B62B 3/02 |

* cited by examiner

MOUNTING FRAME FOR DISPLACING AND FIXING IN A SHAFT

FIELD

The invention relates to a mounting frame for being displaced and fixed in a shaft, which mounting frame can be transported and brought into a shaft and removed from a shaft particularly easily.

BACKGROUND

WO 2017/016780 A1 describes a mounting frame for being displaced and fixed in a shaft in the form of a support component for being displaced and fixed in an elevator shaft of an elevator system. The mounting frame has a rigid main frame in the form of a rack. Primary fixing components in the form of extendable rams are fixedly arranged on a first side of the main frame, by means of which rams the mounting frame is supported on the first shaft wall during fixing. On a second side of the main frame opposite the first side of the main frame in a fixing direction and thus a horizontal direction, a secondary fixing component comprising an immovable secondary contact element that is elongate in a displacement direction is arranged. During fixing, the mounting frame can be supported via the secondary contact element on a second shaft wall opposite the first shaft wall in the fixing direction. Due to the necessary dimensions of the mounting frame for stable fixation in the shaft and the implementation of desired mounting steps in the shaft, the transportation of the mounting frame to a shaft is very complex. This also applies in particular to introducing the mounting frame before the start of and moving the frame out after completion of the process of mounting in the shaft.

SUMMARY

In contrast, it is in particular an object of the invention to propose a mounting frame for being displaced and fixed in a shaft, which frame can be handled particularly easily, i.e., in particular can be transported and brought into a shaft and removed from a shaft particularly easily. This object is achieved according to the invention by a mounting frame having the features described below.

The mounting frame according to the invention for being displaced and fixed in a shaft has a main frame, a first primary fixing component for supporting the mounting frame on a first shaft wall and a secondary fixing component for supporting the mounting frame on a second shaft wall of the shaft opposite the first shaft wall in a fixing direction during fixing of the mounting frame in the shaft. The first primary fixing component and the secondary fixing component are arranged on the main frame. According to the invention, the first primary fixing component and/or the main frame can assume a transport position and a working position, a change of the first primary fixing component and/or the main frame from its working position to its transport position leading to a reduction in an extension of the mounting frame in an extension direction that differs from the fixing direction. The dimensions of the mounting frame with the first primary fixing component and/or the main frame in the transport position, i.e., when the mounting frame is in a transport state, are therefore smaller in the extension direction than with the two components in their relevant working position, i.e., when the mounting frame is in a working state.

The mounting frame is in the working state in particular when it is located in the shaft and allows mounting to be carried out in the shaft. The frame is in the transport state in particular when it is to be transported to a shaft. When the mounting frame is being introduced into and removed from the shaft, both states or a mixed state of the frame are possible in principle. A mixed state is characterized in that either the first primary fixing component or the main frame is in its transport position and the other component in each case is in the working position. When the mounting frame is being introduced into and removed from the shaft, the frame has in particular a mixed state in which the first primary fixing component is in the working position and the main frame is in the transport position. In this case, the main frame, after being introduced, is brought from the transport position to the working position in the shaft, and before being removed is brought from the working position to the transport position.

The small dimensions of the mounting frame in the transport state allow easy transportation to a shaft, i.e., for example from one shaft to the next shaft, i.e., within a building or between buildings. Such transportation has to be carried out in particular on a construction site having many obstacles and also between buildings, for example by means of a truck. In addition, the small dimensions allow easy introduction of the mounting frame into the shaft and easy removal from the shaft. In addition, the separation of the transport state and the working state of the mounting frame allows the dimensions of the mounting frame in the working state to be optimally designed to meet requirements when carrying out the mounting in the shaft. For example, the first primary fixing component can be designed without regard to requirements for transporting the mounting frame, such that secure and stable fixing of the mounting frame in the shaft is made possible in the working position of the first primary fixing component. In its working position, the first primary fixing component can, for example, project far beyond the main frame. For example, the main frame can be designed such that, in its working position, it has dimensions that allow mounting steps to be carried out optimally in the shaft.

The mentioned extension direction corresponds in particular to a displacement direction in which the mounting frame is displaced in the shaft. For a shaft extending vertically, this corresponds to the vertical. The mentioned reduction in the extension of the mounting frame when changing from the working state to the transport state thus corresponds to a reduction in the height of the mounting frame. The extension direction can also differ from the displacement direction, in particular can be designed so as to be inclined relative to the displacement direction, for example inclined by 5-45° relative to the displacement direction. A reduction in the extension of the mounting frame in the extension direction then also leads to a reduction in the height of the mounting frame.

In the transport state, the height of the mounting frame is in particular designed such that it is lower by a sufficient safety margin than a normal height of doors. The height of the mounting frame is at most 190 cm, for example. The mounting frame thus fits through a door of a normal height without tipping, which makes it particularly easy to transport the mounting frame within a building. The width of the mounting frame in the transport state should not exceed 80 cm. This means that doors to be passed through during transport do not have to be particularly wide, but can be designed as standard doors.

The mounting frame can be used to hold a mechatronic installation component, for example in the form of an industrial robot. By means of the mechatronic installation component, mounting steps can be carried out in the shaft in an automated manner when the mounting frame is in the fixed state. The dimensions of the main frame in its working position can then advantageously be designed such that the industrial robot can optimally pick up tools or mounting material, such as screws or anchor bolts, that are arranged at least indirectly on the main frame. This requires a particular distance between the industrial robot and the tool or mounting material, leading to a necessary extension of the main frame in the extension direction and thus to a necessary height of the mounting frame, which can be significantly greater than the above-mentioned maximum height of 190 cm.

The mechatronic installation component can be designed in accordance with the automated installation component from WO 2017/016780 A1, for example. However, the mounting frame can, for example, also support an installation platform or be designed as an installation platform from which a fitter can carry out mounting steps in the shaft by hand or with the aid of tools.

A shaft is to be understood here as an elongate space delimited by shaft walls. The shaft has in particular a mainly rectangular cross section, although other cross sections are also conceivable. The shaft extends in particular in a mainly vertical direction, so that the displacement direction also extends mainly in the vertical direction and the fixing direction accordingly extends mainly in a horizontal direction. The shaft is arranged in particular in a building, although it can also be arranged in a bridge, a pillar or on a ship, for example. The shaft walls consist in particular of concrete reinforced with reinforcements. However, they can also be made of metal, for example. The shaft is used in particular as an elevator shaft of an elevator system, in which shaft, during operation of the elevator system, a car for transporting people and/or objects is displaced in the displacement direction. The shaft can also serve other purposes, for example it can serve as a ventilation shaft or to accommodate pipes, electric cables or the like.

The mounting frame can be displaced in the displacement direction within the shaft and can thus be positioned at different points, in particular at different heights, within the shaft. For this purpose, the mounting frame is suspended from a displacement component, in particular in the form of a winch, in particular via a suspension means, for example in the form of a cable, a chain or a belt. The suspension means can be wound or unwound by the winch, and the mounting frame can thus be displaced in the shaft.

The main frame can, for example, be designed as a simple platform, rack, frame, car, or the like. In particular, it is made of metal, for example metal sections.

In its working position, the first primary fixing component is arranged on the main frame, in particular so as to be immovable relative to the main frame, that is to say without the possibility of movement relative to the main frame. Arranged so as to be immovable is to be understood here as meaning that it can only move minimally, if at all, relative to the main frame. Deformation of a first primary contact element of the first primary fixing component, which element is in contact with the first shaft wall during fixing of the mounting frame, in particular means no movement of the primary fixing component relative to the main frame. A first primary contact element is designed in particular as a rubber buffer. The rubber buffer is fastened to the main frame via, for example, an arm made of metal. The mounting frame has in particular a plurality of, especially two or four, primary fixing components, not all of which have to be able to assume both a transport position and a working position. It is also conceivable for primary fixing components to be able to assume only a working position.

The secondary fixing component has, in particular, at least one controllable actuator, for example in the form of an electric spindle drive or a hydraulic or pneumatic piston-cylinder unit, by means of which a secondary contact element of the secondary fixing component, which element is in contact with the second shaft wall during fixing in the shaft, can be displaced outward, i.e., away from the main frame toward the second shaft wall. The actuator and associated parts of the secondary fixing device are immovably fixed to the main frame, for example screwed on. The second fixing component can also have more than one secondary contact element. It is also possible for the mounting frame to have more than one secondary fixing component, each having at least one secondary contact element. The actuator is controlled by a control device, which in particular can also perform other tasks, such as controlling the displacement component or any mechatronic installation component.

In one embodiment of the invention, the first primary fixing component has an arm and a first primary contact element arranged on the arm. In the working position of the first primary fixing component, the arm extends in the extension direction away from the main frame. For a change of the first primary fixing component from the working position to the transport position, at least part of the arm is displaced toward the main frame. This allows a particularly simple change of the first primary fixing component from the working position to the transport position and back.

The arm of the first primary fixing component is arranged on the main frame so as to be able to pivot via a joint or a pivot axle, for example. In this case, when changing from the working position to the transport position, the arm is pivoted toward the main frame such that the first primary contact element and at least part of the arm is displaced toward the main frame. The pivot axle can, for example, extend in the fixing direction or perpendicularly to the fixing direction and the displacement direction, i.e., horizontally along the first shaft wall. It is also possible for the arm to be arranged so as to be slidable relative to the main frame in the extension direction and for the arm to be slid together with the first primary contact element toward the main frame when changing from the working position to the transport position. Both when pivoting and when sliding, the arm is secured in particular both in the working position and in the transport position by a securing means, for example a bolt.

The first primary contact element is in contact with the first shaft wall during fixing of the mounting frame and is designed, for example, as a rubber buffer. The mentioned arm can be made of metal, for example, and can also extend away from the main frame toward the first shaft wall. An arm of a primary fixing component can also have more than one primary contact element, for example two or four contact elements. It is also possible for the mounting frame to have more than one primary fixing component, for example two or four primary fixing components, each having one or more primary contact elements.

In one embodiment of the invention, in the transport position of the first primary fixing component, no part of the first primary fixing component projects beyond the main frame in the extension direction. This makes it possible to have, in the transport position, particularly small dimensions of the mounting frame in the extension direction.

In one embodiment of the invention, the mounting frame has a second primary fixing component having a second primary contact element for supporting the mounting frame on the first shaft wall during fixing of the mounting frame in the shaft. The second primary fixing component is arranged immovably on the main frame such that no part of the second primary fixing component projects beyond the main frame in the extension direction. This means that the second primary fixing component can assume only a working position. This allows the mounting frame to be fixed particularly securely and stably in the shaft without the dimensions of the mounting frame increasing in the extension direction when the mounting frame is in the transport state.

In particular, the mounting frame has two first primary fixing components, which can assume both a working position and a transport position, and two second primary fixing components, which can assume only a working position. In this case, the arms of the two first primary fixing components are arranged on the main frame in particular so as to be able to pivot.

However, it is also possible for the mounting frame to have four first primary fixing components, all four of which can assume both a working position and a transport position. In this case, the arms of the four first primary fixing components are arranged in particular so as to be able to slide on the main frame. The four arms are in particular rigidly interconnected or form a single component.

In both cases, the four contact elements are arranged in particular such that they form corners of a rectangle of which the edges extend in the displacement direction and in a transverse direction perpendicular to the displacement direction and to the fixing direction.

In one embodiment of the invention, a supporting component for supporting the mounting frame on the first shaft wall of the shaft during displacement of the mounting frame in the displacement direction is assigned to each primary contact element. In addition to allowing secure and stable fixing of the mounting frame in the shaft, this also makes it possible for the mounting frame to be displaced safely without the risk of damage to the mounting frame or the shaft walls.

The above-described suspension means has, in relation to the vertical, in particular a diagonal pull toward the first shaft wall. It can thus be ensured that the mounting frame is also actually supported on the first shaft wall via the supporting component during displacement and that it does not hang freely in the shaft, which could lead to a shaft wall being hit and thus to damage to the mounting frame and the shaft wall. In particular, the mounting frame has a compensating element which counteracts tipping of the mounting frame toward the first shaft wall during displacement. The compensating element is designed in particular in accordance with a compensating element from WO 2018/162350 A1.

The supporting components have, in particular, rollers which can roll along the first shaft wall in the displacement direction. The rollers can also be designed to be pivotable about a pivot axle perpendicularly to the first shaft wall, such that rolling along the first shaft wall transversely to the displacement direction is also possible. The supporting components can, for example, also have sliding elements, for example cuboids made of ceramic. In this case, the sliding elements can slide along the first shaft wall. In particular, the mounting frame has a plurality of, specifically four, supporting components. These are arranged in particular such that they form corners of a rectangle of which the edges extend in the displacement direction and in a transverse direction perpendicular to the displacement direction and to the fixing direction.

The supporting components are arranged on the main frame so as to be movable in relation to the main frame at least in part, in particular in the fixing direction. This means that the components are fixed, for example screwed, directly or indirectly to the main frame and at least some parts of the supporting component are movable relative to the main frame. If the supporting component has a roller, in particular an axle is provided about which the roller can rotate when rolling on the shaft wall, and thus the roller is arranged so as to be movable relative to the main frame in the fixing direction. The axle can, for example, be arranged on a holder fixed rigidly to the main frame. If the supporting component has a sliding element, the mentioned cuboid can be arranged, on a holder fixed rigidly to the main frame, so as to be slidable in the fixing direction. The supporting components are designed and arranged in particular such that they are also in contact with the first shaft wall via the supporting component when the mounting frame is in the fixed state, i.e., in the fixing position of the components.

In one embodiment of the invention, the primary contact element is arranged on the outside in the displacement direction in relation to the relevant supporting component in the working position. This allows for particularly secure and stable support during fixing of the mounting frame. The primary contact elements and the supporting components are in particular arranged such that they each form corners of a rectangle of which the edges extend in the displacement direction and in a transverse direction perpendicular to the displacement direction and to the fixing direction.

In one embodiment of the invention, the main frame has a multi-part design, and at least two parts of the main frame that arranged in alignment in the extension direction are designed so as to be slidable relative to one another, in particular are slidable one inside the other. This allows for a particularly simple and cost-effective design of the main frame. The mentioned parts of the main frame are designed, for example, as hollow sections, in particular metal hollow sections. In order to bring the main frame from the working position to the transport position, a first part is pushed further into a second part of the main frame. An inner contour of the second part is adapted to an outer contour of the first part such that the second part can accommodate the first part. The hollow sections can have a rectangular or circular cross section, for example. In order to secure the working position and the transport position, the parts can have through-holes into which a bolt can be inserted, thus preventing the parts from sliding relative to one another.

In one embodiment of the invention, the mounting frame has an adjustment apparatus by means of which the main frame can be brought from the transport position into the working position and vice versa. This allows the main frame to be brought from the transport position to the working position and back particularly easily. In particular, the adjustment apparatus is designed such that the position of the main frame can also be changed if the main frame is located in the shaft. This advantageously makes it possible for the mounting frame to be brought into the shaft in the transport position of the main frame and only then for the main frame to be brought into the working position. This makes it possible for the mounting frame to be introduced easily into the shaft.

The adjustment apparatus can be actuated by hand, for example, and can have a hand crank for this purpose, for example, by means of which the parts of the main frame can be slid relative to one another via Bowden cables. The adjustment apparatus can, for example, also have a controllable actuator, for example in the form of an electric spindle drive or a hydraulic or pneumatic piston-cylinder unit, by means of which the parts of the main frame can be slid relative to one another.

In one embodiment of the invention, the main frame has a multi-part design, and at least two parts of the main frame that are arranged in alignment in the fixing direction are designed so as to be slidable relative to one another, in particular are slidable one inside the other. An expansion of the main frame can thus be changed in the fixing direction and thus adapted to dimensions of the shaft. The mounting frame can therefore be used in shafts of different designs and therefore can be used particularly flexibly. In addition, particularly small dimensions of the main frame in the fixing direction and thus of the mounting frame can be set for transportation. This allows the mounting frame to be transported particularly easily.

The design of the mentioned two parts in which they are slidable relative to one another is achieved in particular in that a first part can be pushed into a second part to different extents and secured in the desired position, for example by means of a bolt. For this purpose, the two parts are designed, for example, as hollow sections, in particular metal hollow sections, an inner contour of the second part being adapted to an outer contour of the first part such that the second part can accommodate the first part. The hollow sections can have a rectangular or circular cross section, for example. The adaptation of the main frame to the shaft, that is to say the sliding of the mentioned parts of the main frame relative to one another, is carried out in particular by hand and therefore without actuators. The adaptation takes place in particular in a preparatory phase before the mounting frame is displaced in the shaft for the first time. The setting of a particularly small dimension of the main frame for transportation can take place inside or outside the shaft.

In one embodiment of the invention, the secondary fixing component has a secondary contact element which has a shape that is elongate in the displacement direction and which has a multi-part design. The elongate shape allows support on the second shaft wall, even if the wall has openings, for example door openings in the case of an elevator shaft. In particular in the displacement direction, the secondary contact element has such a large extension that it is greater than a maximum extent of an opening in the second shaft wall. The secondary contact element has in particular a mainly bar-shaped basic shape.

A multi-part design of the secondary contact element means that at least part of the secondary contact element can be easily removed and mounted. The extension of the contact element changes in the extension direction as a result of the mentioned removal and mounting. The mentioned part can thus be removed for transporting the mounting frame, with the result that the mounting frame can be transported particularly easily. In addition, the secondary contact element can be adapted to differently designed shafts, in particular to different heights of door openings, by selecting the mounted part accordingly. The secondary contact element is designed in particular such that it can be assembled only after the mounting frame has been introduced into the shaft. This can be done, for example, by a fitter who has access to the shaft and thus to the mounting frame via a door opening.

The secondary contact element consists in particular of three parts, it being possible for a central piece to be rigidly connected to the remaining parts of the secondary fixing component. An end piece can be removed and remounted at the top and bottom of the central piece.

In one embodiment of the invention, the secondary fixing component has a secondary contact element which has a shape that is elongate in the displacement direction and which is designed to be completely removable. The mounting frame can thus be transported particularly easily.

A removable design of the secondary contact element is to be understood to mean that the element can be completely separated from the remaining parts of the secondary fixing component. The secondary contact element can have a single-part design or preferably can have a multi-part design, as described, in which case the central part of the secondary contact element can also be removed.

In one embodiment of the invention, the secondary fixing component has an actuator (already described above) by means of which the secondary contact element can be displaced in the fixing direction and thus a distance between the secondary contact element and the main frame can be changed. The secondary contact element can thus be moved away from the main frame, and thus brought into a fixing position and toward the main frame, and thus into a displacement position. The secondary fixing component is designed such that a distance between the secondary contact element and the main frame in the fixing direction can also be changed independently of the actuator of the secondary fixing component. In this way, the main frame can be positioned in the shaft at a desired position in the fixing direction when the mounting frame is in the fixed state.

This embodiment of the invention, i.e., the described possibility of also changing the distance between the secondary contact element and the main frame in the fixing direction independently of the actuator of the secondary fixing component, can be advantageously implemented independently of a described elongate shape of the secondary contact element.

The described design of the secondary fixing component with the possibility of also changing the distance between the secondary contact element and the main frame in the fixing direction independently of the actuator of the secondary fixing component can also be advantageously implemented in a mounting frame without the above-described features that the first primary fixing component and/or the main frame can assume a transport position and a working position, with a change of the first primary fixing component and/or the main frame from its working position to its transport position leading to a reduction in an extension of the mounting frame in an extension direction that differs from the fixing direction. This leads to a mounting frame for being displaced and fixed in a shaft, comprising a main frame, a first primary fixing component for supporting the mounting frame on a first shaft wall and a secondary fixing component for supporting the mounting frame on a second shaft wall of the shaft opposite the first shaft wall in a fixing direction during fixing of the mounting frame in the shaft. The secondary fixing component then has an actuator by means of which the secondary contact element can be displaced in the fixing direction and thus a distance between the secondary contact element and the main frame can be changed. The secondary contact element can thus be moved away from the main frame, and thus brought into a fixing position and toward the main frame, and thus into a displacement position. The secondary fixing component is designed such that a distance between the secondary contact element and the main frame in the fixing direction can also be changed independently of the actuator of the secondary fixing component.

The described possibility of also changing the distance between the secondary contact element and the main frame in the fixing direction independently of the actuator of the secondary fixing component is advantageous in particular if a mechatronic installation component is arranged on the main frame. The component can thus also be positioned in the shaft at a desired position in the fixing direction. It can thus be positioned in particular such that it can carry out all the envisaged mounting steps, in particular it can reach the locations on the shaft walls that are necessary for this. When the mounting frame is in the fixed state, the main frame is intended to be positioned, for example, such that the mechatronic installation component is arranged centrally in the shaft in the fixing direction. The orientation in the horizontal direction, transverse to the fixing direction, can be set by appropriately positioning the mounting frame in the shaft during the above-mentioned preparatory phase. In addition, particularly small dimensions of the secondary fixing component in the fixing direction and thus of the mounting frame can be set for transportation. This allows the mounting frame to be transported particularly easily.

For this purpose, the secondary contact element of the secondary fixing component is connected to the mentioned actuator in particular via two parts which are designed to be movable relative to one another, in particular to be slidable one inside the other, in the fixing direction. The design of the mentioned parts in which they are movable relative to one another can be achieved by parts of the main frame that are movable analogously to the above-described parts.

The described mounting frame can be used particularly advantageously as part of a mounting apparatus for carrying out automated mounting steps in a shaft. The mounting apparatus also has a mechatronic installation component, as already described above.

The described mounting apparatus can be used particularly advantageously as part of a mounting system for carrying out automated mounting steps in a shaft. The mounting system also has a displacement component for displacing the mounting apparatus in the shaft, as has already been described above.

Further advantages, features and details of the invention can be found in the following description of embodiments and with reference to the drawings, in which like or functionally like elements are provided with identical reference signs. The drawings are merely schematic and not to scale.

DETAILED DESCRIPTION

Figure 1:
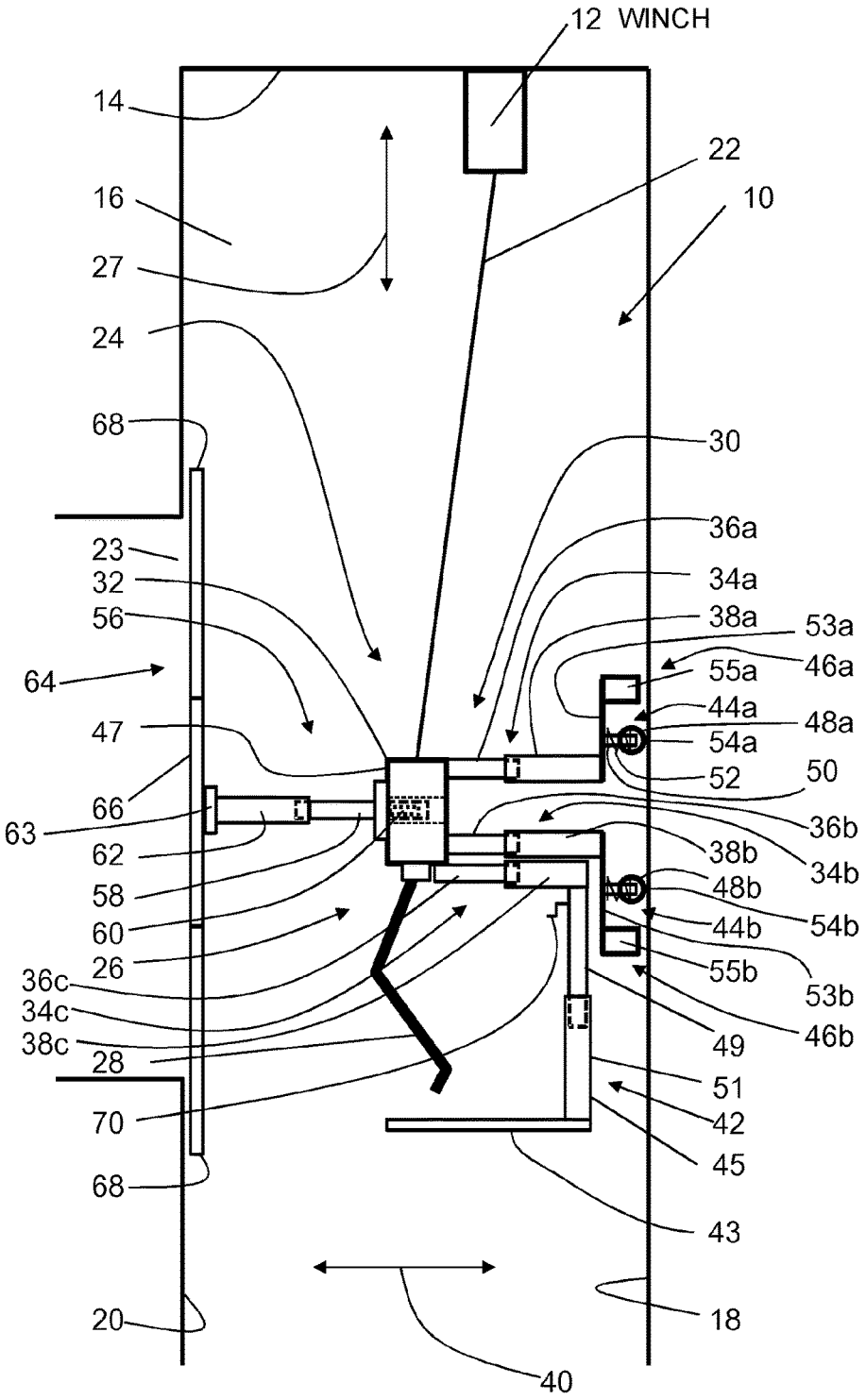
FIG. 1 is a side view of a mounting system in a shaft, with a mounting frame comprising a main frame and a first primary fixing component in a working position.
Figure 2:
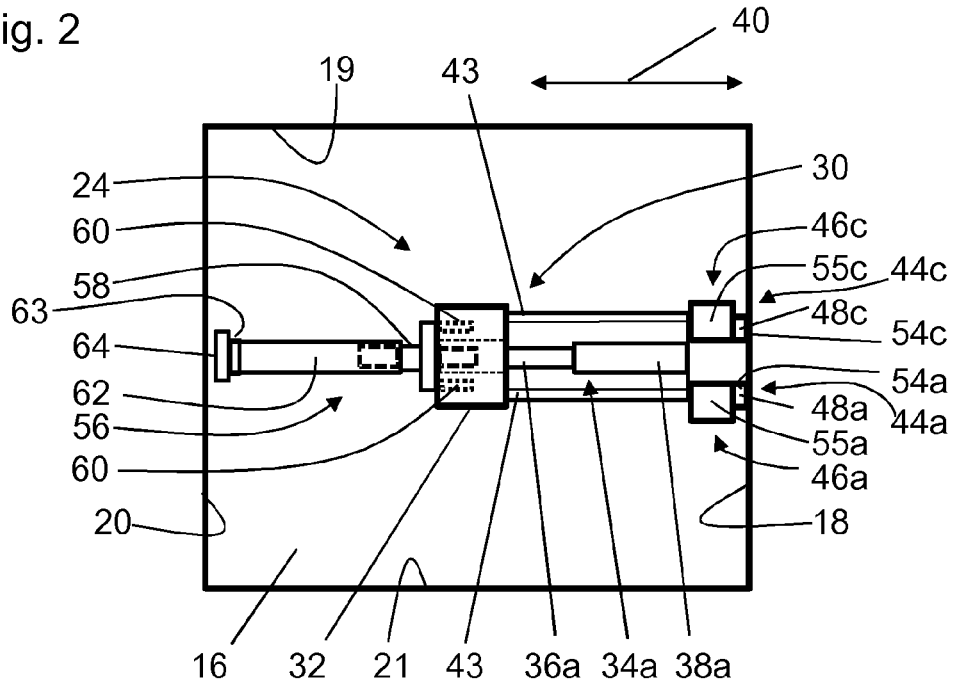
FIG. 2 is a view from above of a mounting apparatus of the mounting system from FIG. 1.

FIGS. 1 and 2 will be discussed first. According to FIG. 1, a mounting system 10 for carrying out automated mounting steps has a displacement component in the form of a winch 12, which is arranged on a shaft ceiling 14 of a shaft in the form of an elevator shaft 16. The elevator shaft 16 is delimited by a total of four shaft walls, of which only a first shaft wall 18 and a second shaft wall 20 that is opposite in a fixing direction 40 are shown in FIG. 1. FIG. 2 also shows a third shaft wall 19 and a fourth shaft wall 21 opposite the third shaft wall 19. According to FIG. 2, the elevator shaft 16 has a mainly rectangular cross section and extends mainly in a vertical direction, the shaft being delimited at the top by the shaft ceiling 14. A shaft floor opposite the shaft ceiling 14 is not shown. The second shaft wall 20 has an opening in the form of a door opening 23 into which a shaft door is inserted when an elevator system is mounted in the elevator shaft 16.

The winch 12 is connected, via a suspension means in the form of a cable 22, to a mounting frame 24 of a mounting apparatus 26 for carrying out automated mounting steps in the shaft 16. The cable 22 can be wound or unwound from the winch 12 and the mounting frame 24 and thus the mounting apparatus 26 can thereby be displaced in the elevator shaft 16, i.e., pulled up and lowered down. The mounting frame 24 and thus the mounting apparatus 26 can therefore be displaced in the elevator shaft 16 in a vertically extending displacement direction 27. A mechatronic installation component in the form of an industrial robot 28 is arranged on the mounting frame 24, by means of which component mounting steps can be carried out in the elevator shaft 16 in an automated manner. The industrial robot 28 is designed, for example, like an industrial robot described in WO 2017/016780 A1, and can automatically carry out the mounting steps described in the document, for example.

The mounting frame 24 and the industrial robot 28 thus form the mounting apparatus 26 for carrying out automated mounting steps. The mounting apparatus 26, the cable 22 and the winch 12 thus form the mounting system 10 for carrying out automated mounting steps.

The mounting frame 24 has a multi-part main frame 30. The main frame 30 has a mainly cuboid central part 32 on which the industrial robot 28 is arranged so as to be suspended downward. The central part 32 can accommodate other components (not shown) of the mounting apparatus 26 or of the mounting frame 24, such as a control device and/or a compressor for providing compressed air. The central part 32 can be sealed from the outside by a housing (not shown). A side of the central part 32 oriented toward the second shaft wall 20 forms a second side 47 of the main frame 30.

The central part 32 is adjoined by three transverse beams 34*a*, 34*b*, 34*c* which extend horizontally and are spaced apart from one another in the displacement direction 27. The transverse beams 34*a*, 34*b*, 34*c* are constructed in two parts, it being possible for a first part 36*a*, 36*b*, 36*c* arranged toward the central part 32 to be pushed into a second part 38*a*, 38*b*, 38*c* arranged toward the first shaft wall 18. The two parts 36*a* and 38*a*, 36*b* and 38*b* and 36*c* and 38*c*, respectively, are arranged in each case in alignment in the fixing direction 40 and can be secured relative to one another by a bolt (not shown). In this way, the expansion or extension of the main frame 30 in the fixing direction 40, which extends horizontally and perpendicularly to the first shaft wall 18 and to the second shaft wall 20, can be changed.

The lowermost transverse beam 34*c* is connected, toward the first shaft wall 18, to a two-part longitudinal beam 42 extending in the displacement direction 27. A first part 49 arranged toward the transverse beam 34*c* can be pushed into a second part 51. The two parts 49, 51 are arranged in alignment in the displacement direction 27 and can be secured relative to one another by a bolt (not shown). In this way, the expansion or extension of the main frame 30 in the displacement direction 27 and thus in an extension direction can be changed. The main frame 30 can assume a working position and a transport position, the working position being shown in FIG. 1.

The longitudinal beam 42 forms a first side 45 of the main frame 30. At the lower end of the longitudinal beam 42, two horizontal supports 43 are arranged which project into the elevator shaft 16 and which, during operation of the mounting apparatus 26, can support one or more magazines comprising mounting material, such as screws or anchor bolts. The main frame 30 is thus composed of the central part 32, the three transverse beams 34*a*, 34*b*, 34*c*, the longitudinal beam 42 and the supports 43. The mentioned parts of the main frame 30 are interconnected in a suitable manner, i.e., plugged, screwed or welded, for example. For example, they are each made of suitable metal sections.

Two combinations of a supporting component 44*a*, 44*c* and a first primary fixing component 46*a*, 46*c* are arranged on the upper transverse beam 34*a* toward the first shaft wall 18. Only a combination of the supporting component 44*a* and the first primary fixing component 46*a* can be seen in FIG. 1. FIG. 2 shows both combinations. Toward the first shaft wall 18, two combinations of a supporting component 44*b* and a second primary fixing component 46*b* are arranged on the middle transverse beam 34*b*. Only a combination of the supporting component 44*b* and the second primary fixing component 46*b* can be seen in FIGS. 1 and 2.

The supporting components 44*a*, 44*b*, 44*c* and the primary fixing components 46*a*, 46*b*, 46*c* are arranged such that they each form corners of a rectangle of which the edges extend in the displacement direction 27 and in a transverse direction perpendicular to the displacement direction 27 and to the fixing direction 40, the primary fixing components 46*a*, 46*b*, 46*c* being arranged further outward in the displacement direction 27 than the supporting components 44*a*, 44*b*, 44*c*.

The primary fixing components 46*a*, 46*b*, 46*c* each have an arm 53*a*, 53*b* which is connected to the relevant transverse beam 34*a*, 34*b*. A primary contact element in the form of a rubber buffer 55*a*, 55*b*, 55*c* is arranged on the relevant arm 53*a*, 53*b* toward the first shaft wall 18.

The arms 53*a* of the two upper, first primary fixing components 46*a*, 46*c* are connected to the upper transverse beam 34*a* via a pivot axle (not shown) extending in the fixing direction 40. The arms 53*a* and thus the two first primary fixing components 46*a*, 46*c* are thus arranged so as to be able to pivot relative to the upper transverse beam 34*a* and thus relative to the main frame 30. The first primary fixing components 46*a*, 46*c* can thus assume a working position and a transport position, the working position being shown in FIG. 1. In the working position, the arms 53*a* extend upward away from the upper transverse beam 34*a* and thus from the main frame 30 in the extension direction and thus in the displacement direction 27. In order to set the transport position, shown in FIG. 3, of the first primary fixing components 46*a*, 46*c*, the arms 53*a* and thus the first primary fixing component 46*a*, 46*c* can be pivoted downward about the pivot axle and thus can be displaced toward the main frame 30. The transport position of the first primary fixing components 46*a*, 46*c* will be discussed in more detail in connection with FIG. 3.

The arms 53*b* of the two lower, second primary fixing components 46*b* are rigidly and therefore immovably connected to the middle transverse beam 34*b* and thus to the main frame 30. No part of the second primary fixing components 46*b* projects beyond the main frame 30 in the extension direction and thus in the displacement direction 27.

The rubber buffers 55*a*, 55*b*, 55*c* are arranged on the relevant transverse beam 34*a*, 34*b* and thus on the main frame 30 via the arms 53*a*, 53*b*. This connection, in the case of the second primary fixing components 46*b*, never permits any movement relative to the main frame 30 in the fixing direction 40, and in the case of the first primary fixing components 46*a*, 46*c* does not permit such a movement at least in their working position.

Each supporting element 44*a*, 44*b*, 44*c* has a roller 48*a*, 48*b*, 48*c* which can be rotated about an axle (not shown) and which can roll along the first shaft wall 18 in the displacement direction 27. The axles of the rollers 48*a*, 48*b*, 48*c* are each fastened, via a holder 50, to the arm 53*a*, 53*b* of the associated primary fixing component 46*a*, 46*b*, 46*c* so as to be movable in the fixing direction 40. For this purpose, the holders 50 can each have a corresponding elongate hole (not shown). Between the arms 53*a*, 53*b* and the relevant axle of the rollers 48*a*, 48*b*, 48*c*, energy storage means in the form of helical springs 52 are arranged such that they press the rollers 48*a*, 48*b*, 48*c* against the first shaft wall 18, such that the rollers 48*a*, 48*b*, 48*c* and thus the supporting components 44*a*, 44*b*, 44*c* are in contact with or supported on the first shaft wall 18 via a relevant supporting surface 54*a*, 54*b*, 54*c*.

A secondary fixing component 56 is arranged on the central part 32 of the main frame 30 toward the second shaft wall 20. An actuating ram 58 extending in the fixing direction 40 is mounted in the central part 32 and projects from the central part 32 toward the second shaft wall 20. The actuating ram 58 can be displaced in the fixing direction 40 by means of two actuators in the form of electric spindle drives 60, i.e., can be extended out of the central part 32 and moved into the central part 32. The actuating ram 58 is connected to a secondary contact element 64, which is elongate in the displacement direction 27, via an intermediate piece 62, which likewise extends in the fixing direction 40 and is therefore arranged in alignment with the actuating ram 58, and via a retaining plate 63. The actuating ram 58 is inserted into the intermediate piece 62 and can be secured in various positions relative to the intermediate piece 62 by a bolt (not shown). A distance between the secondary contact element 64 and the central part 32 and thus the main frame 30 in the fixing direction 40 can also be changed independently of the spindle drives 60 of the secondary fixing component 56.

The secondary contact element 64 has a multi-part design. A central piece 66 can be rigidly connected to the intermediate piece 62 via the retaining plate 63. It is also possible that the central piece 66 can be detached from the retaining plate 63 and that the secondary contact element 64 is thus designed so that it can be completely removed. The central piece 66 is adjoined in the displacement direction 27 at the top and bottom by a relevant end piece 68 that can be easily mounted and removed.

In FIGS. 1 and 2, the four supporting components 44*a*, 44*b*, 44*c* are in the displacement position. The rollers 48*a*, 48*b*, 48*c* project beyond the primary fixing components 46*a*, 46*b*, 46*c* toward the first shaft wall 18. In addition, the secondary contact element 64 of the secondary fixing component 56 is in the displacement position. The secondary contact element 64 is therefore not in contact with the second shaft wall 20 but is at a distance from the second shaft wall 20 in the fixing direction 40.

In this state of the mounting frame 24 and thus of the mounting apparatus 26, the frame can be displaced in the elevator shaft 16 in the displacement direction 27 by means of the winch 12 and the cable 22 and thus can be positioned at different heights. The mounting frame 24 is supported on the first shaft wall 18 via the supporting surfaces 54*a*, 54*b*, 54*c* of the rollers 48*a*, 48*b*, 48*c*. The rollers 48*a*, 48*b*, 48*c* roll on the first shaft wall 18.

In order to fix the mounting frame 24 and thus the mounting apparatus 26 in the elevator shaft 16, the secondary contact element 64 of the secondary fixing component 56 is displaced outward by means of the two spindle drives 60 toward the second shaft wall 20, i.e., away from the main frame 30. As long as the secondary contact element 64 has not reached the second shaft wall 20, the supporting elements 44*a*, 44*b*, 44*c* remain in the displacement position shown in FIGS. 1 and 2. If the secondary contact element 64 is in contact with the second shaft wall 20 and the actuating ram 58 is extended further out of the central part 32, the entire main frame 30 together with all parts arranged immovably thereon is displaced toward the first shaft wall 18. The helical springs 52 of the supporting elements 44*a*, 44*b*, 44*c* are then compressed until the primary fixing components 46*a*, 46*b*, 46*c* are in contact with the first shaft wall 18 via the rubber buffers 55*a*, 55*b*, 55*c*. The mounting frame 24 is thus press-fitted or clamped and thus fixed between the first shaft wall 18 and the second shaft wall 20.

In FIGS. 1 and 2, the mounting frame 24 is shown in a working state. In this working state, the frame is arranged in the shaft 16 and allows mounting in the shaft. The working state is characterized in that

- the first primary fixing components 46*a*, 46*c* are in their working position, i.e., the arms 53*a* extend upward away from the main frame 30,
- the main frame 30 is in its working position, and the two parts 49, 51 of the longitudinal beam 42 are pulled far enough apart for the industrial robot 28 to carry out all the necessary mounting steps,
- the two associated parts 36*a*, 38*a*; 36*b*, 38*b*; 36*c*, 38*c* of the transverse beams 34*a*, 34*b*, 34*c* are arranged relative to one another such that the central part 32 is in a desired position and it is possible to fix the mounting frame 24 in the shaft 16,
- the actuating ram 58 and the intermediate piece 62 of the secondary fixing component 56 are arranged relative to one another such that the central part 32 is in a desired position and it is possible to fix the mounting frame 24 in the shaft 16, and
- the secondary contact element 64 of the secondary fixing component 56 is completely mounted.

Figure 3:
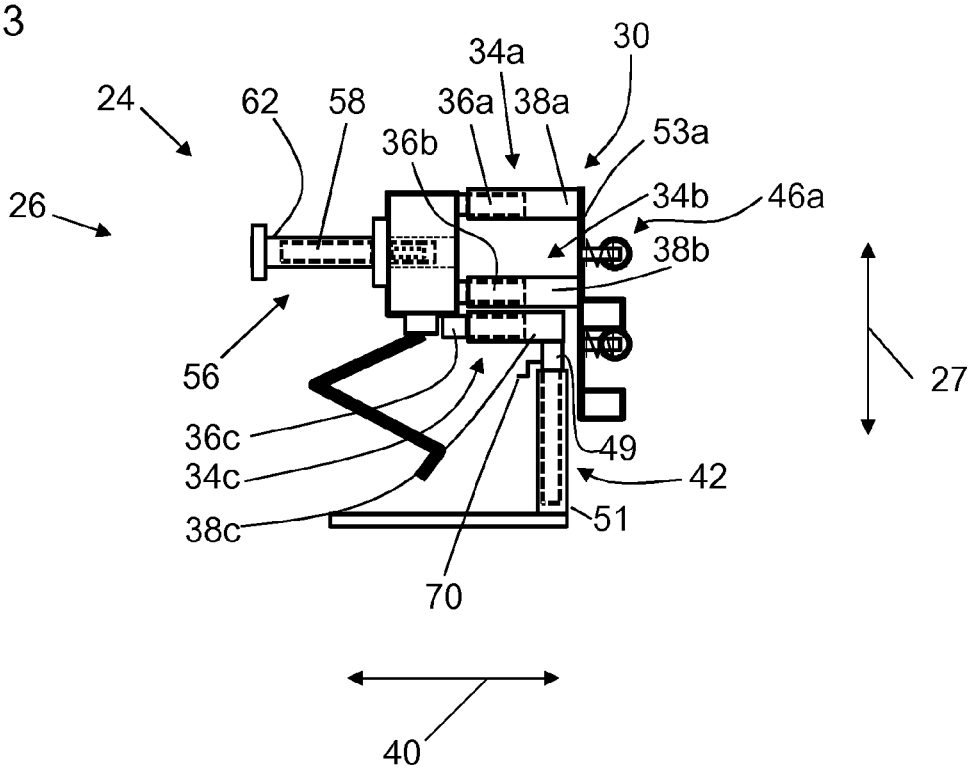
FIG. 3 is a side view of the mounting apparatus of the mounting system from FIG. 1, with a mounting frame comprising the main frame and the first primary fixing component in a transport position.

If the mounting frame 24 and thus the mounting apparatus 26 are to be transported, i.e., for example, to be brought to another shaft, then the mounting frame 24 is brought into a transport state which is illustrated in FIG. 3. The transport state is characterized in that

- the first primary fixing components 46*a*, 46*c* are in their transport position, i.e., the arms 53*a* are pivoted downward toward the main frame 30 such that no part of the first primary fixing components 46*a*, 46*c* projects beyond the main frame 30 in the extension direction,
- the main frame 30 is in its transport position, and the two parts 49, 51 of the longitudinal beam 42 are slid one into the other as far as possible,
- the two associated parts 36*a*, 38*a*; 36*b*, 38*b*; 36*c*, 38*c* of the transverse beams 34*a*, 34*b*, 34*c* are slid one into the other as far as possible,
- the actuating ram 58 and the intermediate piece 62 of the secondary fixing component 56 are slid one into the other as far as possible, and
- the secondary contact element 64 of the secondary fixing component 56 is completely removed.

In order to bring the main frame 30 from its working position into its transport position and vice versa, i.e., to slide the two parts 49, 51 of the longitudinal beam 42 one into the other or to pull them apart, an adjustment apparatus in the form of a crank 70 is arranged on the first part 49 of the longitudinal beam 42, which adjustment apparatus interacts with Bowden cables (not shown) in the two parts 49, 51 of the longitudinal beam 42. By turning this crank 70, the two parts 49, 51 can be slid one into the other and pulled apart. The crank 70 is arranged such that it can also be actuated from outside the shaft 16 if the mounting frame 24 is located in the shaft 16.

The extension of the mounting frame 24 in the extension direction and thus in the displacement direction 27 is significantly smaller in the transport state than in the working state. This reduction results from the change of the first primary fixing components 46*a*, 46*c* from their working position to their transport position and from the change of the main frame 30 from its working position to its transport position.

In addition, the extension of the mounting frame 24 in the fixing direction 40 is significantly smaller in the transport state than in the working state. This reduction results from sliding the associated parts 36*a*, 38*a*; 36*b*, 38*b*; 36*c*, 38*c* of the transverse beams 34*a*, 34*b*, 34*c* one inside the other, from sliding the actuating ram 58 and the intermediate piece 62 of the secondary fixing component 56 one inside the other, and from the removal of the secondary contact element 64 of the secondary fixing component 56.

Finally, it should be noted that terms such as "having," "comprising," etc. do not preclude other elements or steps and terms such as "a" or "an" do not preclude a plurality. Furthermore, it should be noted that features or steps that have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A mounting frame for being displaced and fixed in a shaft, the mounting frame comprising:

- a main frame;
- a first primary fixing component adapted to support the mounting frame on a first shaft wall during fixing of the mounting frame in the shaft;
- a secondary fixing component adapted to support the mounting frame on a second wall of the shaft opposite the first shaft wall in a fixing direction during fixing of the mounting frame in the shaft;
- wherein the first primary fixing component and the secondary fixing component are arranged on the main frame;
- wherein the first primary fixing component and/or the main frame can assume a transport position and a working position;
- whereby a change of the first primary fixing component and/or the main frame from the working position to the transport position reduces an extension of the mounting frame in an extension direction that differs from the fixing direction;

wherein the first primary fixing component has an arm and a primary contact element arranged on the arm, the arm extending away from the main frame in the extension direction when the primary fixing component is in the working position, and at least a part of the arm is displaceable toward the main frame enabling a change of the primary fixing component from the working position to the transport position; and including a second primary fixing component having a another primary contact element adapted to support the mounting frame on the first shaft wall during fixing of the mounting frame in the shaft, the second primary fixing component being immovably arranged on the main frame such that no part of the second primary fixing component projects beyond the main frame in the extension direction.

2. The mounting frame according to claim 1 wherein when the first primary fixing component is in the transport position, no part of the first primary fixing component projects beyond the main frame in the extension direction.

3. The mounting frame according to claim 1 including a supporting component adapted to support the mounting frame on the first shaft wall of the shaft during displacement of the mounting frame in a displacement direction and being arranged on the arm adjacent to the primary contact element.

4. The mounting frame according to claim 3 wherein the primary contact element is arranged outside in the displacement direction in relation to the supporting component in the working position.

5. The mounting frame according to claim 1 wherein the main frame is multi-part and has at least two parts that are aligned in the extension direction, the at least two parts being slidable relative to one another.

6. The mounting frame according to claim 5 wherein the at least two parts are slidable one inside another.

7. The mounting frame according to claim 5 including an adjustment apparatus by which the main frame can be brought from the transport position into the working position and vice versa.

8. The mounting frame according to claim 1 wherein the main frame is multi-part design and has at least two parts that are aligned in the fixing direction, the at least two parts being slidable relative to one another.

9. The mounting frame according to claim 8 wherein the at least two parts are slidable one inside another.

10. The mounting frame according to claim 1 wherein the secondary fixing component has a secondary contact element that is elongate in shape in the displacement direction and is multi-part.

11. The mounting frame according to claim 1 wherein the secondary fixing component has a secondary contact element that is elongate in shape in the displacement direction and is completely removable from the main frame.

12. The mounting frame according to claim 1 wherein the secondary fixing component has a secondary contact element and an actuator for displacing the secondary contact element in the fixing direction thereby changing a distance between the secondary contact element and the main frame, and wherein the distance between the secondary contact element and the main frame in the fixing direction can be changed independently of the actuator.

13. A mounting apparatus for carrying out automated mounting steps in a shaft, the mounting apparatus comprising the mounting frame according to claim 1 and a mechatronic installation component arranged on the mounting frame.

14. A mounting system for carrying out automated mounting steps in a shaft, the mounting system comprising the mounting apparatus according to claim 13 and a displacement component for displacing the mounting apparatus in the shaft.

15. A mounting frame for being displaced and fixed in a shaft, the mounting frame comprising:

a main frame;

a first primary fixing component adapted to support the mounting frame on a first shaft wall during fixing of the mounting frame in the shaft;

a secondary fixing component adapted to support the mounting frame on a second wall of the shaft opposite the first shaft wall in a fixing direction during fixing of the mounting frame in the shaft;

wherein the first primary fixing component and the secondary fixing component are arranged on the main frame;

wherein the first primary fixing component and/or the main frame can assume a transport position and a working position;

whereby a change of the first primary fixing component and/or the main frame from the working position to the transport position reduces an extension of the mounting frame in an extension direction that differs from the fixing direction;

wherein the first primary fixing component has an arm and a primary contact element arranged on the arm, the arm extending away from the main frame in the extension direction when the primary fixing component is in the working position, and at least a part of the arm is displaceable toward the main frame enabling a change of the primary fixing component from the working position to the transport position; and including a supporting component adapted to support the mounting frame on the first shaft wall of the shaft during displacement of the mounting frame in a displacement direction and being arranged on the arm adjacent to the primary contact element.

16. The mounting frame according to claim 15 wherein the primary contact element is arranged outside in the displacement direction in relation to the supporting component in the working position.

* * * * *